United States Patent [19]

Narang

[11] Patent Number: 4,549,525

[45] Date of Patent: Oct. 29, 1985

[54] OIL AND GAS WATER HEATER

[76] Inventor: Rajendra K. Narang, 1525 Bonnie Rd., Macedonia, Ohio 44056

[21] Appl. No.: 101,873

[22] Filed: Dec. 10, 1979

[51] Int. Cl.[4] ..... F24H 1/14

[52] U.S. Cl. ..... 126/361; 126/351; 126/362; 122/17; 122/13 R; 122/14; 236/45; 236/46 A; 236/25 A

[58] Field of Search ..... 126/361, 362, 389, 351; 122/13 R, 14, 17, 446, 45, 48, 20 B; 236/25 A, 45

[56] References Cited

U.S. PATENT DOCUMENTS

| | | | |
|---|---|---|---|
| 652,024 | 6/1900 | Gray | 236/25 A |
| 884,223 | 4/1908 | Shipley | 126/351 |
| 981,571 | 1/1911 | Kay | 236/25 A |
| 1,098,733 | 6/1914 | Kane | 236/25 A |
| 1,248,143 | 11/1917 | Lovekin | 126/362 |
| 1,286,098 | 11/1918 | Radcliffe | 236/25 A |
| 1,833,049 | 11/1931 | Hasenauer | 236/45 |
| 1,853,702 | 4/1932 | Schmidt | 236/25 A |
| 1,885,053 | 10/1932 | Slough | 236/46 |
| 1,961,231 | 6/1934 | Maier | 122/17 |
| 2,522,091 | 9/1950 | Burwell | 122/14 |
| 2,642,046 | 6/1953 | Alexander | 126/362 |
| 2,692,640 | 10/1954 | Field | 236/45 |
| 3,091,223 | 5/1963 | Vitale | 122/17 |
| 3,707,142 | 12/1972 | Kobayashi | 122/13 R |
| 3,822,039 | 7/1974 | Mori et al. | 236/75 |
| 4,147,159 | 4/1979 | Thornaldson | 236/25 A |
| 4,178,907 | 12/1979 | Sweat, Jr. | 122/20 B |

*Primary Examiner*—Henry C. Yuen

*Attorney, Agent, or Firm*—Renner, Otto, Boisselle & Lyon

[57] ABSTRACT

A heater system having improved efficiency and performance embodies air and fuel regulator valves, water and air supply jackets, and flow directors for the hot combustion gas generated by the heater burner which gas passes through a central flue in a water storage tank and is then exhausted through an exhaust vent to atmosphere. The air and fuel regulator valves are non-electrically controlled and are responsive to water demand requirement for improved heater efficiency and performance. The water supply jacket closely surrounds the central flue and receives supply water at the top thereof and discharges same to the bottom of the storage tank thereby increasing the heat transfer characteristics of the heater. The air supply jacket surrounds the exhaust vent and air is drawn in through the top of the jacket along the exhaust vent for preheating and then is directed to the burner to support combustion. The flow director is positioned between the burner and the base or the storage tank for directing the flow of hot combustion gas radially outwardly and then inwardly along the full extent of the tank base to increase heat transfer surface area and time.

15 Claims, 12 Drawing Figures

182
178
180
164
166
172
56
58
70
72
80

56
58
70
82
84
S̄ N̄ S N
72

140
148
154
153
152
150
HOT WATER 205
208
212

214
204
206
210

GAS
54
GAS VALVE
GAS
58
66
60
52
79
64
70
72
68
72
62
56
4
4

WATER OUTLET
78
60
68
76
WATER INLET 86
88
96
100
114
98
108
92
106
94
102
104
M
H L
110
90
112

OIL AND GAS WATER HEATER

FIELD OF THE INVENTION

This invention relates to an improved heater for a fluid such as water, and more particularly to a water heater that employs gas or oil as its heat generative source.

Fluid heaters such as hot water heaters have many applications. At the domestic level, hot water heaters are employed to provide a supply of hot water for usage in the home and/or may be employed with pumps or the like for circulation of the hot water through registers in the various rooms of a house for space heating purposes. Ordinarily, such conventional domestic hot water heaters to which this invention is principally directed, take the form of a vertical cylindrical tank having a central cylindrical heat transfer wall or flue through which hot combustion gas passes from an oil or gas burner element positioned centrally beneath the storage tank. Temperature responsive regulators are provided for controlling fuel combustion at the burner to maintain the temperature of the water contained in the storage tank within a predetermined range. When the water temperature falls below the lower limit of such range, either as a result of heat loss to the environment from the storage tank or because of demand, the burner will ignite to restore the temperature of the tank to its maintenance level. The hot combustion gas generated by the burner is directed upwardly through the flue for transfer of heat therefrom to the water contained within the storage tank, and then is exhausted to atmosphere through a vent and/or chimney or the like.

In these days of rising fuel costs due to inflation and scarcity of fuel supplies, it is desirable to provide an efficient hot water heater which maximizes the quantity of high temperature water delivered by the heater per unit of fuel consumed. However, many hot water heaters today are inefficient leading to increased fuel usage and cost. One drawback, for example, of known heaters is their inability to extract greater amounts of heat energy from the escaping hot combustion gas whereby hot combustion gas containing still-extractable heat is lost to atmosphere. In those heaters which seek to minimize such lost heat energy, expensive and electrically dependent components are known to be employed. Moreover, because heaters are normally located in otherwise heated environments, many known heater systems provide a direct escape path for warm room air to atmosphere which passes through the central flue and out the chimney. In addition, the room air drawn through the heater extracts heat from the higher temperature water and exhausts same through the chimney. Accordingly, more energy is consumed to offset these losses. Another drawback of known heaters stems from the fact that the hot combustion gas essentially pass unrestricted, and relatively rapidly, through the flue of the heater out the chimney. One attempt to lengthen the path of the hot combustion gas to increase the passage time through the heater has been to employ a spiral baffle within the flue.

OBJECTS OF THE INVENTION

In view of the foregoing, it is a principal object of this invention to provide a heater for fluids such as water of improved efficiency which heats greater quantities of hot water per energy unit consumed.

Another principal object of this invention is the achievement of such energy efficiency and improved performance without the need for expensive electrical components thereby reducing the cost of the heater and making operation thereof independent of an electrical supply.

Other objects and advantages of this invention will become more apparent below.

SUMMARY OF THE INVENTION

To the achievement of the foregoing objects and other objects of this invention, and according to one feature of this invention, a heater for a fluid such as water includes a storage tank and burner for heating the same, and self-regulating means or override regulator responsive to hot water demand for increasing fuel flow to the burner for increased combustion thereat. The self-regulating means is arranged preferably to override a temperature responsive regulator or control unit which is operative to maintain a desired water temperature in the tank. Under demand conditions, the self-regulating means permits greater fuel flow to the burner for maintaining or restoring the temperature level of the water in the tank as heated water is withdrawn therefrom and substituted with relatively cold water. Under reduced demand conditions, the self-regulating means restricts fuel flow to the temperature responsive control unit whereby recovery and maintenance of the water temperature are achieved at lower combustion rates which results in reduced heat loss to the environment. Accordingly, high combustion rates are provided only when necessitated by demand conditions.

According to another feature of this invention, combustion air supplied to the burner from the environment is regulated such that only sufficient quantities of air are supplied to the combustion chamber as needed to support full combustion of fuel at the burner. To the achievement thereof, the supply of air to the burner is regulated by a damper which is connected to an actuator responsive to water flow through the heater. As the rate of flow of water to the heater increases, increased quantities of air are supplied to the burner to support greater combustion. Otherwise, the damper is closed to prevent flow of warm room air by convection or otherwise through the heater to the chimney, which flow of room air also would extract heat from the heated fluid in the heater as well as from the room. A barometric damper is provided in the combustion chamber to ensure some air flow to the burner to support combustion during the restoration period when the burner remains on but water flow has ceased.

According to still another feature of the invention, combustion supporting air supplied to the burner may be preheated by otherwise waste energy. To this end, a jacket surrounds a vent provided in the hot water heater. The jacket is open at the top end thereof for ingestion of air. The air is drawn through the jacket and then is directed through an outer tank jacket to the burner at the base of the tank to support combustion.

A further feature of the invention is to provide for increased heat transfer within the heat exchanger portions of the tank. Relatively cold water supplied to the tank is directed initially in close proximity to the central flue in the storage tank while initially being maintained separated from the water in the storage tank. To this end, the cold water may be channeled through a spiral conduit positioned in the central flue with the water being received at the top end thereof and injected at the bottom thereof into the storage tank. Alternatively, a jacket within the storage tank may surround the central flue with cold water fed into the jacket at the top end thereof and delivered into the storage tank at the lower end thereof. In either instance, heat transfer is increased due to the greater temperature differential between the hot combustion gases passing through the central flue and the incoming cold water.

A still further feature of this invention is the provision of flow restrictors which substantially decrease the rate of flow of the exiting hot gases and lengthen the path thereof for increasing heat transfer surface area. To this end, the storage tank at its lower end is preferably convex and a flow director or baffle plate is positioned intermediately the convex lower end of the tank and the burner located centrally beneath the tank. Such baffle plate directs the hot combustion gases radially outwardly to the outer extent of the convex tank bottom and then radially inwardly along the entire bottom surface of the tank. The central flue of the tank may also include a coiled flow restrictor screen which disrupts the flow of the gas through the flue thereby increasing the passage time and flow path of the hot combustion gas. Moreover, to provide for localized greater heat transfer as desired, the central flue may have a tapered profile with the greater diameter located at either the top or bottom thereof.

To the accomplishment of the foregoing and related ends, the invention comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DESCRIPTION OF THE PREFERRED EMBODIMENTS

Figure 1:
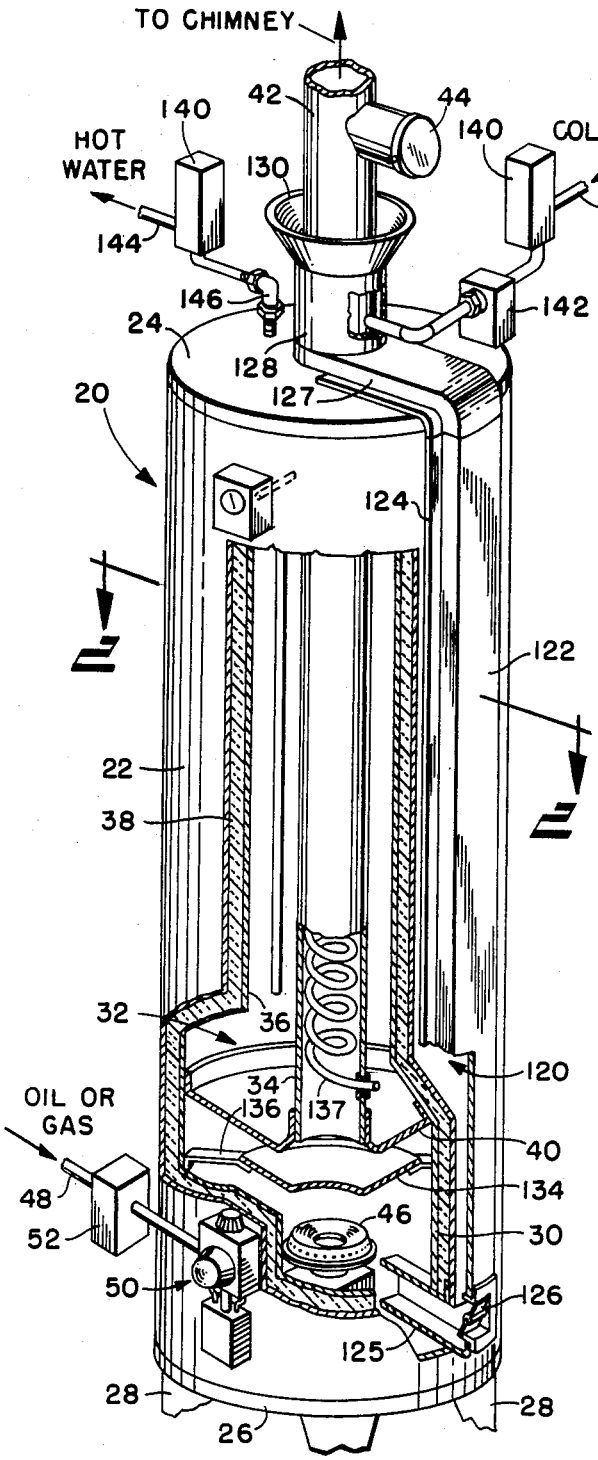
FIG. 1 is a perspective view of a fluid heater constructed in accordance with the invention, which heater is shown partly broken away and in section for illustrative purposes.

Referring now to the drawings, several preferred embodiments of the invention are shown respectively in FIGS. 1–8, 9 and 10, 11 and 12, in which are illustrated the features of the invention for obtaining improved energy efficiency and performance in heaters for fluids such as water. Although some and not all features of the invention are illustrated in any one embodiment thereof, it should be understood that any one feature may be employed independently or in combination with any other feature or features of the invention with such feature or combination of features providing together and in combination for improved efficiency and performance in the fluid heater. For a complete understanding of the embodiments and features of the invention as generally referred to above, reference may be had to the following detailed description.

The FIGS. 1–8 Embodiment

Figure 2:
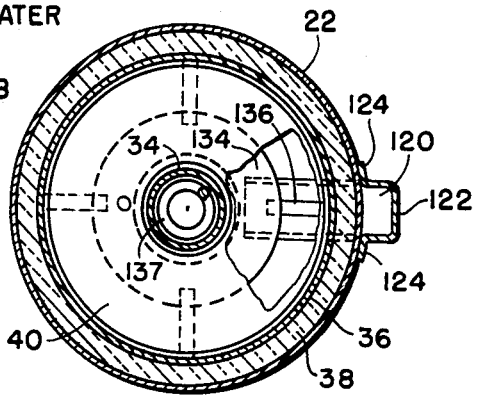
FIG. 2 is a horizontal section through the fluid heater of FIG. 1, taken along the line 2—2 thereof.

In FIGS. 1 and 2, a heater for a fluid, and principally water, is designated generally by reference numeral 20. The water heater 20 includes an outer cylindrical tank skin 22 which is closed at its ends by a top cap 24 and base cap 26, the latter of which may be supported above the floor by legs 28. Supported on the base cap 26 interiorly of the tank skin 22 by a cylindrical tank support 30 is a fluid storage tank 32 which may be formed of a molded glass lining or, as shown, a fabricated sheet metal lining preferably of a non-corrosive type metal such as stainless steel. Such storage tank 32 includes two concentric cylindrical liner members, an inner liner 34 and an outer liner 36. Between the outer liner 36 and tank skin 22 may be disposed a layer of insulation 38. The inner and outer liners are joined together at their respective top and bottom ends by top and bottom annular members, the latter of which is designated by reference numeral 40. Both annular members are secured at their outer peripheries to the outer liner 36 and have central openings at which they are secured to the inner liner 34 thereby to complete the storage tank 32. As will be appreciated below, the storage tank 32 is watertight for containing a quantity of water to be heated.

For heating of the water stored in the tank 32, the inner liner 34 acts as a central flue through which hot combustion gases flow from its lower or inlet end to its upper or outlet end. Since the water contained in the tank 32 normally will be at a temperature less than the hot combustion gases, the inner liner 34 forms a heat exchange wall through which heat energy is transferred from the hot combustion gases to the water.

As the hot combustion gases will pass upwardly through the inner liner or flue 34, the same are exhausted through exhaust vent 42. The exhaust vent is about the same in diameter as the inner liner 34 and is secured to the storage tank at its top coaxially with the inner liner. The exhaust vent 42 extends upwardly through an opening in top cap 24 and forms a continuation of the inner liner 34 for exhausting the hot combustion gases, for example, to a chimney (not shown). For proper exhausting of the hot gases, the exhaust vent 42 may include therein a barometric damper 44 to balance pressures in the vent while precluding exhausting of room air from the tank environment through the exhaust vent except as required.

Hot combustion gases are supplied to the inlet end of the inner liner 34 for passage along the heat exchange wall thereof by an oil or gas burner 46, positioned centrally beneath the storage tank 32. Oil or gas fuel is supplied to the burner 46 from a source or supply thereof through gas line 48. Flow of such fuel through line 48 is controlled by in-line temperature responsive control unit 50 and self-regulating means such as demand responsive override regulator 52. The gas control unit may be of conventional construction while the override regulator 52 of the invention is described below in greater detail along with its operation.

Figures 3, 4, 5, 6, 7, 8, 10, 11, 12:
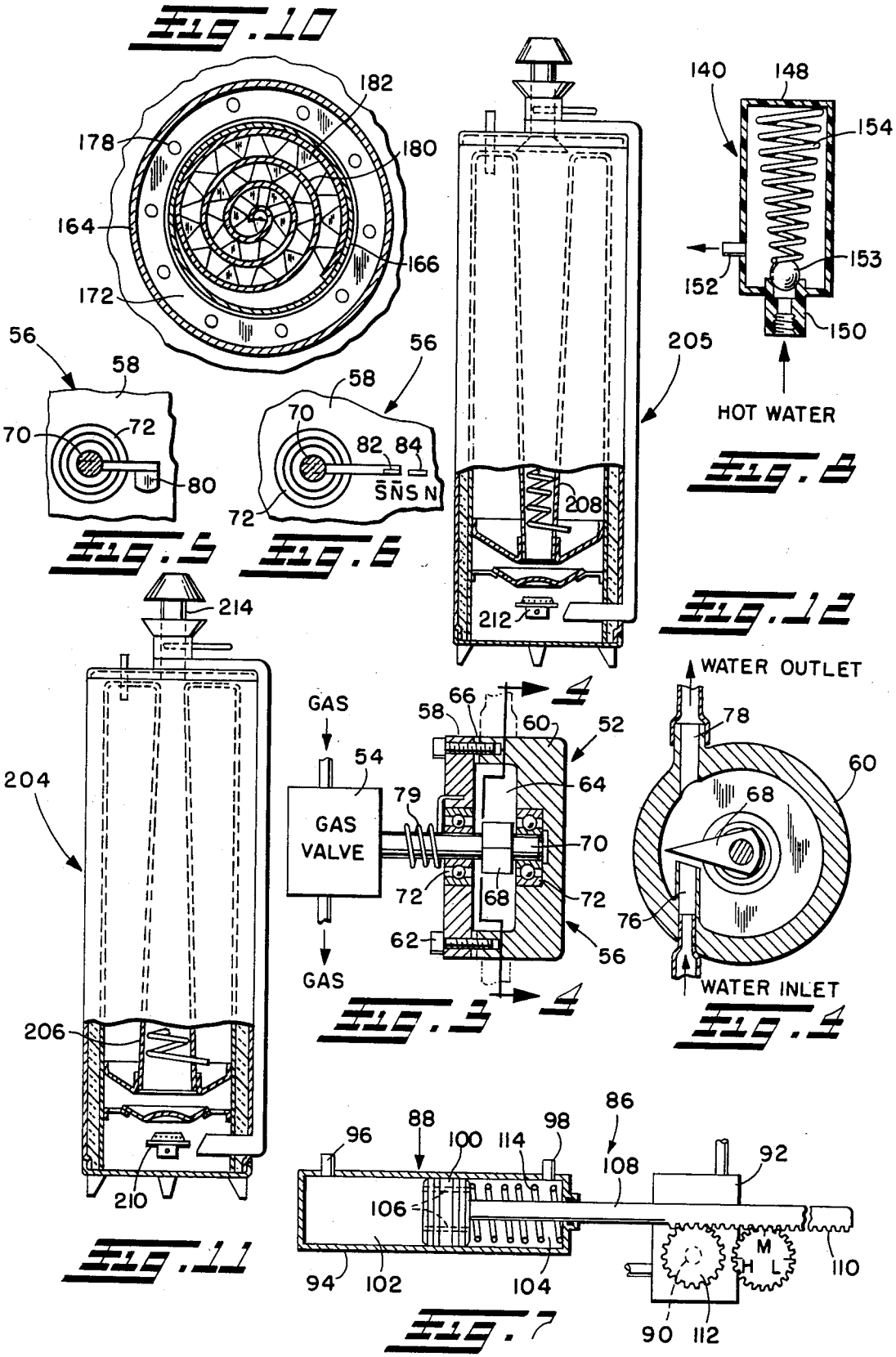
FIG. 3 is a longitudinal section through an override regulator constructed in accordance with the invention for employment with a fluid heater such as that shown in FIG. 1.
FIG. 4 is a transverse section through the override regulator of FIG. 3 taken along the line 4—4 thereof.
FIGS. 5 and 6 are fragmentary transverse sections through a modified override regulator similar to that of FIGS. 3 and 4 but employing different valve biasing means.
FIG. 7 is a longitudinal section through another form of override regulator.
FIG. 8 is a longitudinal section through a preferred form of insulating check valve.
FIG. 10 is a horizontal section of the fluid heater of FIG. 9, taken along the line 10—10 thereof, showing principally the restrictor screen positioned within the central flue of the storage tank.
FIGS. 11 and 12 are side elevations of other modified fluid heaters constructed in accordance with the invention, such fluid heaters being partly broken away and in section for illustrating alternate central flue constructions.

Referring now to FIGS. 3 and 4, the override regulator 52 is shown to include a fuel valve 54 and a valve actuator 56 responsive to fluid flow therethrough. The actuator 56 includes a base plate 58 to which is secured a bell-cover 60 by fasteners 62 and together the cover and base define an interior chamber 64. A fluid gasket 66 may be provided between the cover and base plate to insure fluid tightness. The cover 60 and plate 58 when secured together define a circular chamber in which is pivotally mounted an arm or flipper 68. Preferably the arm 68 is mounted directly on the stem 70 of the valve 54 which stem is suitably journalled by bearings 72 in the plate and housing. The stem 70 may also be provided with seals (not shown) to prevent leakage.

The actuator 56 further includes a fluid inlet 76 and outlet 78 which may be formed integrally into the cover 60. The inlet 76 extends into the chamber into close proximity with the distal or free end of arm 68 such that fluid exiting the inlet into the chamber will impinge upon the arm to cause the same to pivot and thereby rotate the valve stem 70. As shown, the arm 68 is biased by spring 79 against the inlet 76. Accordingly, as fluid passes through the valve, the stem 70 of the fuel valve 54 will be rotated proportionally to the rate of fluid flow thereby proportionately regulating the flow of gas through the valve 54.

With the actuator 56 connected in line with the supply or outlet line for the tank and the valve 54 in line with the fuel supply line as seen in FIG. 1, it can be appreciated that the supply of fuel to the burner 46 can be regulated directly in proportion to demand requirements. As demand is increased, greater quantities of fuel will be supplied to the burner to restore the temperature of the fluid in the tank to its maintenance level. However, when fluid flow is minimal or non-existent, preferably only sufficient fuel is supplied to the burner to support a relatively low rate of combustion.

Preferably the override regulator 52 is arranged to override the temperature responsive control unit 50 which is operative to maintain a desired temperature in the tank. Under demand conditions, the override regulator 52 permits greater fuel flow to the burner 46 for maintaining the temperature level of the fluid in the tank as heated fluid is withdrawn therefrom and substituted with relatively cold fluid. Under reduced demand conditions the override regulator 52 restricts flow to the unit 50 whereby recovery and maintenance of the fluid temperature is achieved at a lower or nominal combustion rate which results in greater fuel efficiency and reduced heat loss to the environment. Accordingly, high combustion rates are provided only when necessitated by demand conditions.

In FIG. 5, it can be seen that in place of the spring 79, the arm of the actuator can be biased towards the actuator inlet by a counterweight 80 mounted on the valve stem 70. It, of course, will be understood that necessary precautions should be taken to insure that such a valve is mounted in such a manner to enable proper operation of the valve. In FIG. 6, the fuel valve is biased towards its closed position by means of magnets 82 and 84 mounted respectively on the valve stem 70 and base plate 58 of the actuator 56. The magnets are so arranged that when the valve is in its nominal or closed position, the north pole of one magnet 82 and the south pole of the other magnet 84 are aligned. Any movement caused by flow through the actuator will be resisted by the attraction of the magnets towards one another and when flow stops, the arm will be caused by the magnets to return to its nominal position.

In FIG. 7, another type of override regulator 86 is shown employing a piston cylinder assembly 88 operative to rotate the valve stem 90 of a gas valve 92. The piston-cylinder assembly 88 includes a cylinder casing 94 including inlet 96 and outlet 98 at its respective ends. A piston 100 is disposed intermediately the inlet and outlet defining respective chambers 102 and 104 in communication therewith. The piston 100 also includes metering orifices 106 through which fluid may flow from one chamber to the other. The piston is connected to piston rod 108 which includes at its outer end a rack 110 in operative engagement with a pinion 112 mounted on the valve stem 90 of the gas valve 92. The piston 100 is normally biased to a nominal position by means of a spring 114.

The inlet 96 and outlet 98 are to be coupled in line with the fluid supply line of the tank. As fluid is withdrawn from the tank and replaced, fluid will flow through the cylinder casing 94 and be metered through the orifices 106 thereby creating a pressure differential between the two chambers 102 and 104 which is proportional to the rate of flow of the fluid through the cylinder. As a result of the pressure differential, the piston 100 will be urged against the spring biasing force thereby to rotate the valve stem 90 to increase fuel flow through the valve 92 thereby to increase the quantity of fuel supplied to the burner 46.

Reverting back to FIGS. 1 and 2, air to support combustion at the burner 46 is supplied through an air preheater assembly including an outer duct 120 formed by tank jacket 122 which at least partially surrounds the tank skin 22. The tank jacket 122 is in the form of a sheet metal strip which is bent radially inwardly along its vertical edges and then laterally outwardly to form mounting flanges 124. The mounting flanges abut the outer surface of the tank skin 22 and are secured thereto by suitable means such as by rivets or by welding. The tank jacket 122 extends substantially the length of the heater and at its lower end communicates with a radially inwardly extending air feeder tube 125 which terminates at an open end in close proximity to the burner 46. The lower end of the outer duct 120 also communicates with the tank environment through barametric damper 126 to balance pressures in the outer duct as required. The top end of the jacket 122 communicates with a radially extending jacket 127 secured to the outer surface of the top cap 24. The top jacket 127 extends from the tank jacket 122 to a cylindrical vent jacket 128 which surrounds the upwardly extending exhaust vent 42 over a length thereof. The vent jacket 128 is open and flared at its top end to form an inlet 130 for ingestion of air.

With the foregoing construction, air will be drawn as required to support combustion at burner 46 through inlet 130 and along the relatively hot exhaust vent 42 whereby the air will be preheated. As the air is drawn along the exterior of the tank skin 22 through tank jacket 122, the air may gain additional heat as a result of heat radiating from such tank skin 22. The preheated air is then delivered to the burner 46 through tube 125 for supporting combustion of fuel at the burner. Because the air is preheated, less fuel is required to achieve a desired temperature of the hot combustion gases. Moreover, no additional energy is required to preheat the air as the same is preheated by waste heat otherwise lost through the chimney or to the surrounding room environment. This consideration is particularly important where the heater is employed in a relatively cool unheated room.

With combustion occurring at the burner 46 disposed centrally beneath the tank, the bottom annular member 40 of the tank is exposed to hot combustion gases and thus acts as another heat exchange wall for the tank 36. In known heaters of conventional construction, the base of the storage tank is concave and funnels the hot gases directly into the inner liner 34. Accordingly, the hot gases pass rapidly by the bottom annular member resulting in relatively little transfer of heat through the bottom annular member 40 as the amount of heat transferred from the hot combustion gases to the water in the tank is proportional to the exposure time as well as the heat exchange surface area.

To enhance heat transfer at the base of the tank, a baffle plate 134 is positioned in the combustion chamber between the burner 46 and annular member 40. The baffle plate 134 may be secured within the combustion chamber by brackets 136 which extend radially outwardly from the plate and are secured by suitable means to the cylindrical tank support 30. Further in accordance with the invention, it will be seen that the annular member 40 gives the base of the tank 32 a convex shape. Such shape is mimicked by the baffle plate 134, although the baffle plate does not extend the full radial extent of the annular member 40. With such construction, hot combustion gases flowing upwardly from the burner 46 initially will be directed radially outwardly by the baffle plate 134. Then, the hot combustion gases will impinge upon the radially outer portions of the annular member 40 and flow radially inwardly and downwardly therefrom along the surface of annular member 40 to the inlet of inner liner 34. Accordingly, greater quantities of heat will be extracted from the combustion gases through the annular wall 40 because of the increased heat exchange surface and reduced flow rate caused by the cooperating baffle plate 134 and convex annular member 40.

As the hot combustion gases rise in the inner liner 34, the same will serve to preheat a cold water supply tube 137 positioned within the inner liner 34. The supply tube 137 is spiralled to maximize the heat exchange surface area thereof and extends substantially the length of inner liner 34. The tube is suitably secured to the liner, and at its upper end, extends radially outwardly through the exhaust vent 42 and vent jacket 128 for connection to a supply line 138.

The supply line 138 may have positioned in-line therewith an insulating check valve 140 and filter 142. Another insulating check valve 140 may be positioned in-line with hot water line 144 and hot water outlet fitting 146 in communication with the storage tank at the top thereof. As seen in FIG. 8, the insulating check valve 140 includes a body 148 preferably made of a plastic material or like material having high thermal resistance. The body 148 includes inlet fitting 150 and outlet fitting 152. The inlet fitting 150 is positioned centrally at the base of the body 148 and is formed with a valve seat against which valve ball 152 is seated. The ball 152 is normally urged against the seat by spring 154. The check valve permits flow of fluid therethrough as needed. However, under no demand conditions, heat energy by convection or conduction is prevented from being passed through the check valve to the supply line 138 or the water contained therein.

Figure 9:
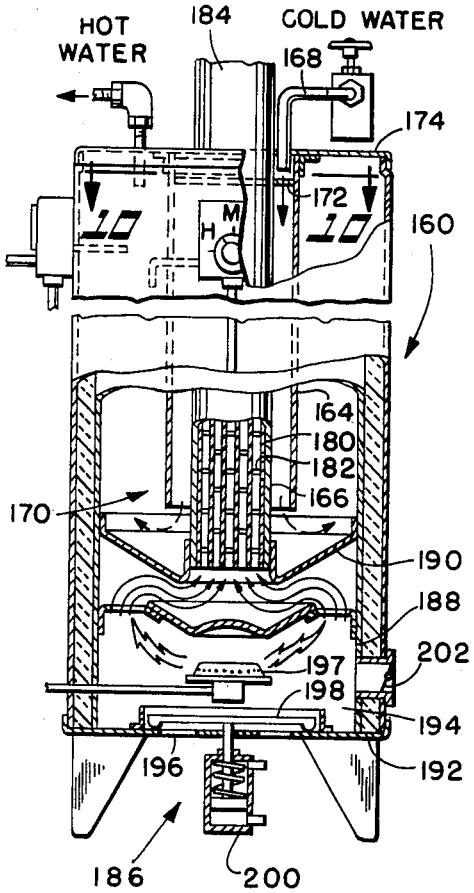
FIG. 9 is a fragmentary side elevation, partly broken away and in section, of a modified fluid heater constructed in accordance with the invention.

The FIGS. 9 and 10 Embodiment

In FIGS. 9 and 10, a modified heater 160 is shown. The heater 160 is of generally like construction to the heater 20 of FIGS. 1 and 2; however, it can be seen that cold water is fed into the tank through a cylindrical flue jacket 164 which surrounds the inner liner 166. The flue jacket 164 at its top end is connected to the cold water feed-line 168 and extends downwardly and preferably to the lower end of the storage tank 170 where the jacket opens to the interior of the storage tank. To ensure more even distribution of the inlet water around the inner liner 166, an annular horizontal disc 172 surrounds the inner liner 166 at the top of the tank and defines with the inner liner 166, flue jacket 164 and top cap 174 an annular passage to which feed line 168 opens. The disc 172 has a number of circumferentially arranged openings 178 therein whereby incoming water is distributed evenly around the inner liner 166.

It will be appreciated that because the cold water initially is maintained separated from the warmer water in the tank as it passes along the inner liner 166, greater heat transfer occurs because of the greater temperature differential between the cold inlet water and hot combustion gases passing upwardly through the inner liner 166.

Further to extract more heat from the escaping hot combustion gases, a screen restrictor 180 is positioned within the inner liner 166. The screen restrictor 180 is rolled longitudinally to form a spiral and includes a plurality of spacer elements such as triangular shape fins 182 which extend horizontally and space adjacent turns of the spiral screen apart from one another. The screen and fins disrupt the flow of the hot combustion gases through the inner liner to increase the residence time therein, and further to increase the flow path of the hot combustion gases. Such reduction of flow rate through the flue results in greater transfer time and hence greater extraction of heat from the hot combustion gases prior to the same being exhausted through vent 184 to the chimney.

The modified heater 160 also includes an air regulating system 186 which controls the flow of air through the heater. In FIG. 9 it can be seen that the cylindrical support 188, annular member 190 and base cap 192 define a closed combustion chamber 194 but for the flue defined by inner liner 166 and openings 196 in the base cap 192 through which air may be supplied to the burner 197 to support combustion. A damper 198 is movable vertically to close the combustion chamber to atmosphere by blocking the vent openings 196. Movement of the damper 198 is obtained by an actuator 200 which is operatively connected in line with the cold water feed line 168 in such a manner that as water is supplied to the heater, the water flow through the actuator will urge the damper upwardly thereby opening the vent openings 196 to supply air to the burner 197 for supporting combustion of the fuel.

When the damper plate 198 is in its open position, air is permitted to pass through the vent openings 196 in the base cap into the combustion chamber to support combustion of fuel at the burner. When in its closed position, air flow into the combustion chamber 194 is cut off, and as a result, no flow of air is permitted through the inner liner 166. Without such arrangement, warm room air would otherwise be continually drawn by connection through the inner liner 166 to the vent 184 resulting in extraction of room heat as well as heat from the fluid contained within the tank. Preferably, the actuator 200 urges the damper upwardly a distance proportional to the water flow rate so that air flow to the burner is similarly proportionally varied. With the fuel flow to the burner similarly varied proportionally to water flow by the override regulator 52, full combustion can be obtained with minimal excess air flow through the heater. In those instances where water flow has ceased yet the burner remains on to bring the water temperature back to its maintenance level, a barometric damper 202 is provided to supply the needed quantity of air to support combustion.

The FIGS. 11 and 12 Embodiment

Referring now to FIGS. 11 and 12 wherein there are shown respectively modified heaters 204 and 205 of generally like construction to the heater of FIGS. 1 and 2, it can be seen that the inner liner 206 in heater 204 is tapered with the smaller diameter thereof at its upper end as seen in FIG. 11 and the inner liner 208 in heater 205 is tapered with the smaller diameter at its lower end as seen in FIG. 12. Because the central flues formed by the liners are tapered, flow characteristics of the upwardly rising hot combustion gases generated by the respective burners 210 and 212 are varied to obtain greater heat transfer.

In the FIG. 11 heater 204, the flow rate of the hot combustion gases through the inner liner 206 will be substantially reduced due to a developed back pressure therein caused by the liner's taper. Such reduction of flow rate through the liner results in greater heat transfer time and hence greater extraction of heat from the hot combustion gases prior to being exhausted through vent 214. In the FIG. 12 heater 205, the taper of the inner liner 208 will cause a negative gas pressure gradient to develop therein from the lower end of the heater to its upper end. The pressure of the hot combustion gases will drop gradually as they rise through the inner liner resulting in greater heat extraction than would occur in a like heater with a conventional untapered inner liner. It should also be appreciated that in both heaters 204 and 205, there is provided a greater heat exchange surface per volumetric space occupied by the inner liners in the heater thereby resulting in still greater extraction of heat without increasing the overall size of the heater.

Although the invention has been shown and described with respect to certain preferred embodiments, it is obvious that equivalent alterations and modification will occur to others skilled in the art upon the reading and understanding of the specifications. The present invention includes all such equivalent alterations and modifications and is limited only by the scope of the claims.

What is claimed is:

1. A heater for fluids such as water comprising a storage tank for the fluid, said storage tank having a fluid inlet and outlet, burner means for buring fuel to heat the fluid in said storage tank, temperature responsive fuel control means operative to supply fuel to said burner means when the temperature of the fluid in said storage tank falls below a maintenance level to restore the temperature of the fluid in said storage tank to such maintenance level, and regulating means responsive to fluid flow through said storage tank for controlling the quantity of fuel supplied to said burner means by said temperature responsive fuel control means when operative.

2. The heater of claim 1 wherein said regulating means, when said temperature responsive fuel control means is operative, maintains a nominal rate of fuel flow to said burner means under no fluid flow conditions and a higher rate of fuel flow to said burner means under fluid flow conditions.

3. The heater of claim 2 wherein said regulating means regulates such higher rate of fuel flow directly in proportion to the rate of fluid flow through said storage tank.

4. The heater of claim 3 wherein said regulator means includes a valve for said fuel, and actuator means responsive to fluid flow through said tank for varying the extent to which said valve is open.

5. The heater of claim 4 wherein said valve includes a rotatable stem for opening and closing same, and said actuator means includes biasing means for biasing the stem to a first position and means responsive to fluid flow through said tank for rotating said stem against said biasing means to a second position to open further said valve.

6. The heater of claim 5 wherein said biasing means includes a spring.

7. The heater of claim 5 wherein said biasing means includes a counterweight.

8. The heater of claim 5 wherein said biasing means includes a magnet.

9. The heater of claim 5 wherein said actuating means comprises a fluid chamber having an inlet and outlet and an arm coupled to said stem for rotational movement therewith, the distal end of said arm being in line with the path of fluid exiting said inlet.

10. The heater of claim 5 wherein said actuating means comprises a cylinder having respective ends, an inlet at one end and an outlet at the other end, a piston movable in said cylinder longitudinally, orifice means for restricting but permitting passage of fluid through said cylinder and a rod connected to said piston for movement therewith, said rod including rack means and a pinion connected to said stem, said pinion in mating engagement with said rack.

11. The heater of claim 3 wherein said storage tank has inner and outer tubular walls defining a fluid storage area therebetween, said burner means being positioned beneath said tank, said inner tubular wall forming a flue for hot combustion gases generated by said burner, and further comprising a tubular vent forming a continuation of said flue for exhausting the hot combustion gases, a vent jacket surrounding said vent, said vent jacket being open at its upper end for ingestion of air and including an opening at its bottom end for passage of preheated air therethrough, and passage means communicating with said opening for channeling the preheated air to said burner for supporting combustion thereat.

12. The heater of claim 3 wherein said tank is vertically orientated having a base and central flue and said burner means is positioned centrally beneath the tank, and further comprising means for directing initially hot combustion gases radially outwardly and then radially inwardly along the base of said tank.

13. The heater of claim 3 wherein said tank is vertically orientated having a central flue, a fluid inlet and means for directing incoming fluid from said inlet into close proximity to said flue for maximizing heat transfer from the hot combustion gases in the flue to the incoming fluid.

14. The heater of claim 13 comprising a spiral screen in said central flue and a plurality of radially extending spacers secured to said screen for radially spacing apart adjacent turns of said screen.

15. The heater of claim 13 wherein said central flue is tapered along its vertical length.

* * * * *